US011517058B2

(12) United States Patent
Moon et al.

(10) Patent No.: US 11,517,058 B2
(45) **Date of Patent: *Dec. 6, 2022**

(54) HEAD CRADLE INCLUDING A HEAD BAND MEMBER HAVING EXCELLENT FLEXIBILITY

(71) Applicant: 3M INNOVATIVE PROPERTIES COMPANY, St. Paul, MN (US)

(72) Inventors: Jungchul Moon, Hwaseong-si (KR); Kyung Sun Choi, Hwaseong-si (KR); JongTae Kim, Suwon-si (KR); Inkyu Park, Suwon-si (KR)

(73) Assignee: 3M Innovative Properties Company, St. Paul, MN (US)

( * ) Notice: Subject to any disclaimer, the term of this patent is extended or adjusted under 35 U.S.C. 154(b) by 670 days.

This patent is subject to a terminal disclaimer.

(21) Appl. No.: 16/477,994

(22) PCT Filed: Jan. 18, 2018

(86) PCT No.: PCT/IB2018/050323
§ 371 (c)(1),
(2) Date: Jul. 15, 2019

(87) PCT Pub. No.: WO2018/134767
PCT Pub. Date: Jul. 26, 2018

(65) Prior Publication Data

US 2020/0221796 A1 Jul. 16, 2020

(30) Foreign Application Priority Data

Jan. 19, 2017 (KR) ..... 10-2017-0009065

(51) Int. Cl.
*A62B 9/00* (2006.01)
*A41D 13/11* (2006.01)
(Continued)

(52) U.S. Cl.
CPC ..... *A41D 13/1161* (2013.01); *A44B 11/06* (2013.01); *A62B 9/04* (2013.01); *A62B 18/084* (2013.01)

(58) Field of Classification Search
CPC ... A41D 13/1161; A44B 11/065; A44B 11/06; A62B 9/04; A62B 18/084; A62B 18/00; A63B 71/10; A61M 16/0683
See application file for complete search history.

(56) References Cited

U.S. PATENT DOCUMENTS 4,454,880 A * 6/1984 Muto ..... A61M 16/0683 128/207.18
5,464,010 A 11/1995 Byram
(Continued)

FOREIGN PATENT DOCUMENTS

JP 2009/203569 9/2009
JP 5103220 9/2009
(Continued)

OTHER PUBLICATIONS

Machine English Translation for JP5103220 description and claims; 2012.*
(Continued)

*Primary Examiner* — Samchuan C Yao
*Assistant Examiner* — Tyler A Raubenstraw
(74) *Attorney, Agent, or Firm* — Steven A. Bern

(57) ABSTRACT

According to one embodiment of the present disclosure, the head cradle including 5 two head band members fastened to each other is provided, where the head band member includes: a support member extending in one direction; a first fastening part formed at one end portion of the support member and having an insertion hole formed to pass therethrough; a second fastening part formed at the other end portion of the support member; and a strap connection part
(Continued)

which is formed at an end portion of the first 0 fastening part or the second fastening part and to which a strap connected to a mask main body is connected, where the support member includes a hole-section on which at least one slit hole having a shape extending at a predetermined angle with respect to the one direction is formed.

18 Claims, 11 Drawing Sheets

(51) Int. Cl.

| | |
|---|---|
| ***A44B 11/06*** | (2006.01) |
| ***A62B 9/04*** | (2006.01) |
| ***A62B 18/08*** | (2006.01) |

(56) References Cited

U.S. PATENT DOCUMENTS

| | | | | |
|---|---|---|---|---|
| 6,070,579 | A * | 6/2000 | Bryant | A41D 13/1161 128/207.11 |
| 6,119,693 | A | 9/2000 | Kwok | |
| 6,318,369 | B1 * | 11/2001 | Gregory | A62B 18/08 128/857 |
| 6,328,031 | B1 * | 12/2001 | Tischer | A62B 17/04 128/206.28 |
| 6,907,882 | B2 | 6/2005 | Ging | |
| D532,511 | S | 11/2006 | Amarasinghe | |
| 7,743,767 | B2 * | 6/2010 | Ging | A61M 16/0616 128/200.24 |
| 8,839,785 | B2 | 9/2014 | Castiglione | |
| 2003/0140402 | A1 * | 7/2003 | Schmidtke | A62B 18/084 2/417 |
| 2006/0196511 | A1 * | 9/2006 | Lau | A61M 16/0666 128/207.18 |
| 2008/0190432 | A1 | 8/2008 | Blochlinger | |
| 2008/0295845 | A1 * | 12/2008 | Nashed | A61M 16/085 128/206.26 |
| 2011/0155140 | A1 * | 6/2011 | Ho | A61M 16/08 128/207.18 |
| 2011/0220115 | A1 * | 9/2011 | Castiglione | A61M 16/0683 128/207.11 |
| 2012/0030912 | A1 * | 2/2012 | Turdjian | A41D 13/1161 24/196 |
| 2013/0199537 | A1 * | 8/2013 | Formica | A61M 16/0616 128/205.25 |
| 2014/0216463 | A1 | 7/2014 | Cowell | |
| 2014/0238401 | A1 * | 8/2014 | Paschall | A61M 16/0816 128/205.25 |
| 2016/0258455 | A1 * | 9/2016 | Chang | F16B 2/08 |
| 2017/0150771 | A1 | 1/2017 | Huh | |

FOREIGN PATENT DOCUMENTS

| | | | |
|---|---|---|---|
| JP | 5103220 | B2 * | 12/2012 |
| KR | 10-1250425 | | 2/2013 |
| KR | 10-2013-0049180 | | 5/2013 |
| WO | WO 2012-104756 | | 8/2012 |
| WO | WO 2017-031263 | | 2/2017 |

OTHER PUBLICATIONS

International Search report for PCT International Application No. PCT/IB2018/050323 dated Apr. 30, 2018, 3 pages.

* cited by examiner

HEAD CRADLE INCLUDING A HEAD BAND MEMBER HAVING EXCELLENT FLEXIBILITY

CROSS REFERENCE TO RELATED APPLICATIONS

This application is a national stage filing under 35 U.S.C. 371 of PCT/IB2018/050323, filed Jan. 18, 2018, which claims the benefit of Korean Application No. 10-2017-0009065 filed Jan. 19, 2017, the disclosure of which is incorporated by reference in its/their entirety herein.

BACKGROUND

A respirator is a protective device to prevent a wearer from suctioning contaminants contained in a surrounding environment, and is pressed against and is worn on a nose and mouth of the wearer to separate contaminated surrounding air from the inside of a mask in which clean air is contained. In this case, the mask may be used for filtering air passing therethrough. Such a respirator has been used for many industries including construction, manufacturing, automotive painting and repairing, pharmaceutical production, surgery, and the like.

Such a respirator is connected to a head cradle which is provided so that a strap connected to both ends of the mask is worn on the wearer's head, and the mask may be maintained in a close contact state with a face of the wearer by the head cradle.

One example of the conventional head cradle used for wearing the above-described respirator is disclosed in the Patent Document 1.

A head cradle disclosed in the Patent Document 1 includes first and second lateral extension members, and is configured such that the first and second lateral extension members are fit on a wearer's head and supported when the wearer wears a respirator. In this case, the first and second lateral extension members are formed to be pivotable with respect to each other on a pivot point so that when the wearer puts a mask around his/her neck, the first and second lateral extension members may be changed into a folded state by pivoting the first and second lateral extension members in a direction in which the members approach each other. Thus, a mask main body may be positioned at a storage position where a face is not covered when seen from in front of a chest of the wearer.

SUMMARY

However, the above-described conventional head cradle has the following problems.

In the head cradle, a head band part surrounding the worker's head is manufactured in a non-bent flat shape. This head hand part is bent to fit a head size of the worker when the head cradle is worn on the worker's head. Accordingly, the head band part of the head cradle has a problem that, when flexibility required for bending at the time of wearing is not secured sufficiently, a crack occurs due to repetition of bending when wearing the head cradle.

In addition, there is a problem that a first lateral extending member and a second lateral extending member constituting the head cradle have different shapes and should be manufactured through separate processes so that the manufacturing process is not simple.

Further, when the first lateral extending member and the second lateral extending member are mutually pivoted and worn on a head, relative positions of the two members are mutually fixed by a latch means, however, the latch means prevents only the second lateral extending member from escaping outside a latch of the first lateral extending member, but the second lateral extending member is not prevented from moving to the inside of the latch, therefore, there is a problem that the two members are not completely fixed to each other and may transmit a rattling feeling to the wearer.

In addition, when the second lateral extending member is fastened to the latch, when the wearer pushes the second lateral extending member to the inside of the latch continuously in a state in which the second lateral extending member is held at the outside of the latch, the second lateral extending member is suddenly inserted into and fastened to the latch, so that when the head cradle is worn, a soft click sense is not provided, and even when the head cradle is folded to put the head cradle around a neck, there is a problem that a click sense is not soft.

Embodiments of the present disclosure are proposed in order to solve the above-described problems and provide a head cradle having excellent flexibility to withstand repeated bending.

In addition, embodiments of the present disclosure provide a head cradle including a head band member which is made by a simple manufacturing process, is capable of transmitting a feeling to a wearer that a mask is stably fixed to the wearer's head when the mask is worn on a face and may transmit a soft click sense when being folded or unfolded to wear the mask on a head or put the mask around a neck.

According to one aspect of the present disclosure, a head cradle including two head band members fastened to each other is provided, the head band member includes a support member configured to extend in one direction; a first fastening part formed at one end portion of the support member and having an insertion hole formed to pass therethrough; a second fastening part formed at the other end portion of the support member; and a strap connection part which is formed at an end portion of the first fastening part or the second fastening part and to which a strap connected to a mask main body is connected, wherein the support member includes a hole-section on which at least one slit hole having a shape extending at a predetermined angle with respect to the one direction is formed.

The embodiments of the present disclosure are advantageous in that a head band member and a head cradle have excellent flexibility and are not damaged even when repeatedly worn.

In addition, a manufacturing process is simple, it is possible to transmit a feeling that a head cradle is stably fixed to a wearer's head to the wearer when a mask is worn on the face, and a soft click sense can be transmitted to the wearer when the head cradle is folded or unfolded for wearing the mask on a head or putting the mask around a neck.

Further, after being fastened once, head hand members are not easily separated from each other even when a head cradle is used for a long time, so that the use lifetime of a product can extend when compared with a conventional product.

DETAILED DESCRIPTION

Hereinafter, specific embodiments for implementing the spirit of the present disclosure will be described in detail with reference to the accompanying drawings. Here, it is noted that the drawings are not drawn to the same scale for convenience of description. In addition, in the description of the present disclosure, certain detailed descriptions of known configurations or functions of the related art will be omitted when they are deemed to unnecessarily obscure the essence of the present disclosure.

Figure 1:
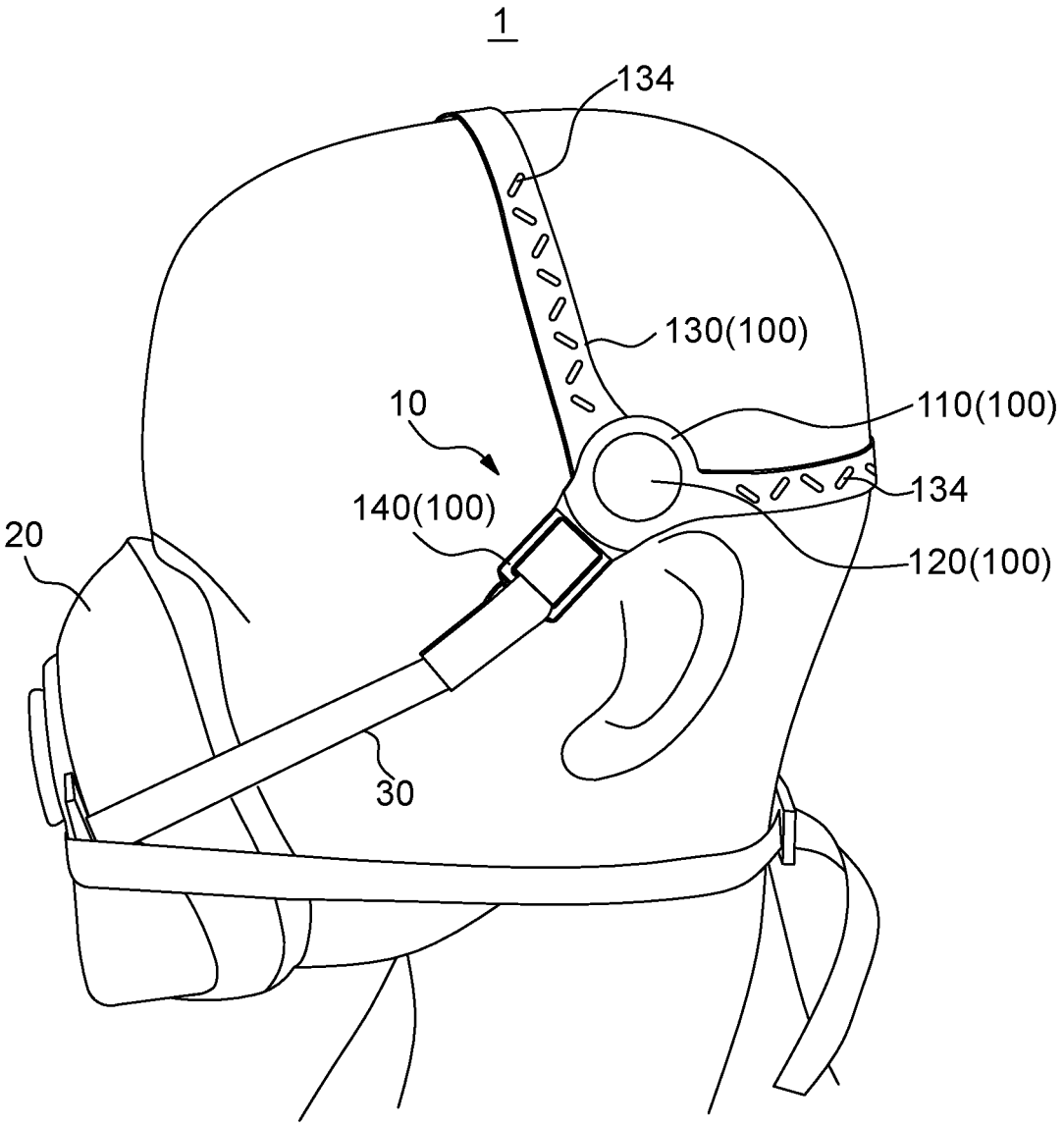
FIG. 1 is a view illustrating a state in which a head cradle according to a first embodiment of the present disclosure is worn on a wearer's head.
Figure 2:
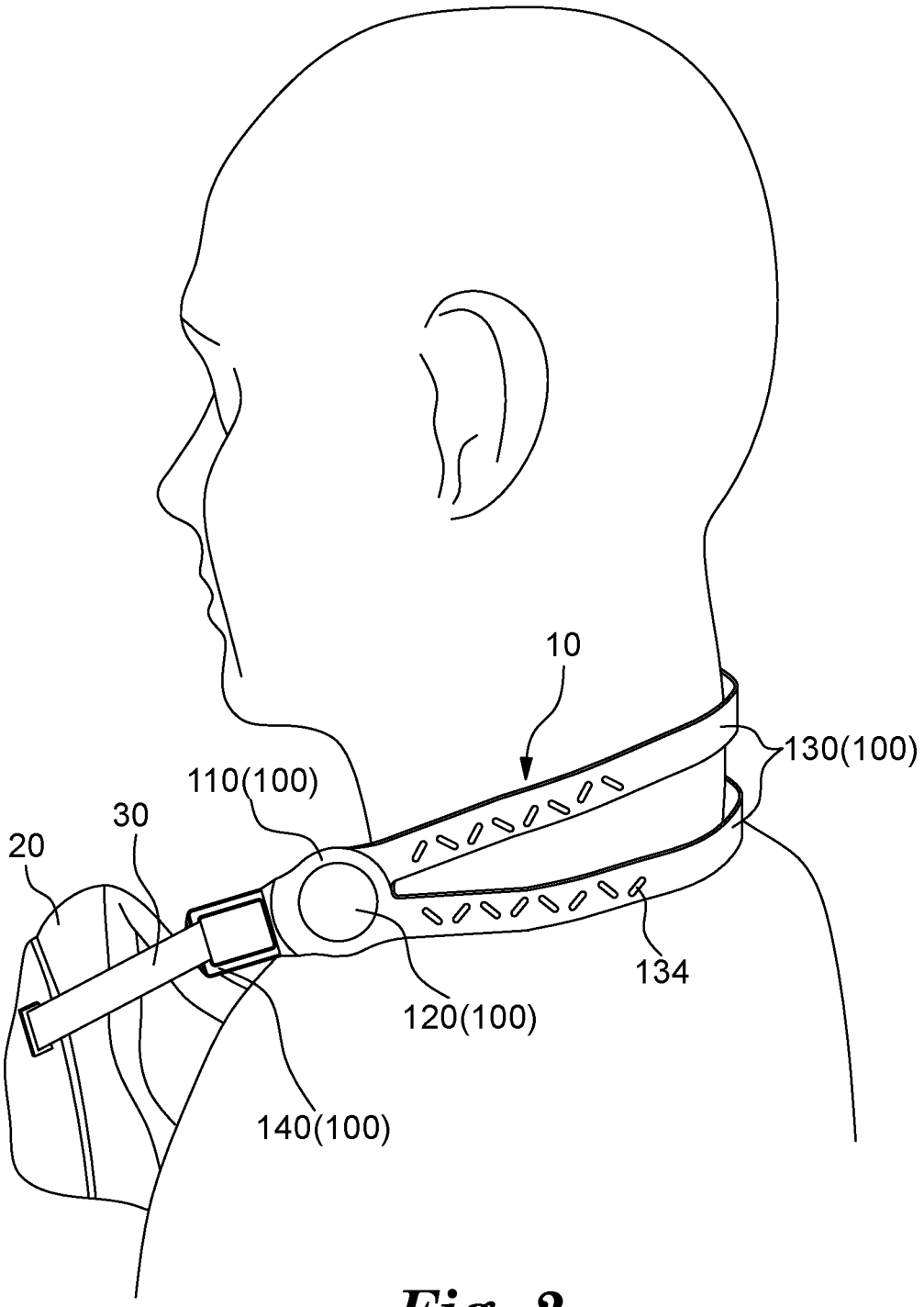
FIG. 2 is a view illustrating a state in which the head cradle shown in FIG. 1 is folded and is put around a wear's neck.
Figure 3:
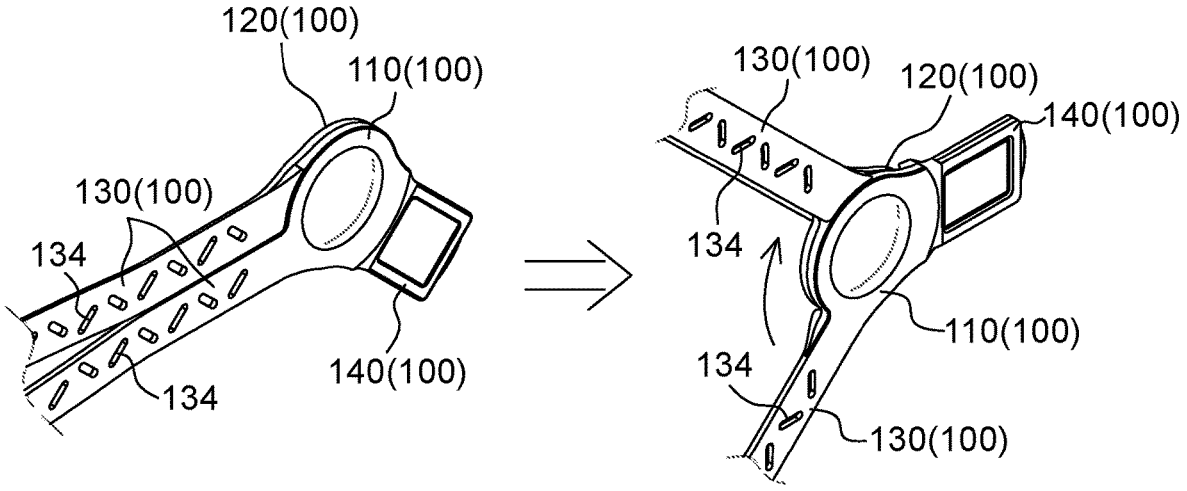
FIG. 3 shows a view illustrating a folded shape and an unfolded shape of the head cradle shown in FIG. 1.

FIG. 1 is a view illustrating a state in which a head cradle according to a first embodiment of the present disclosure is worn on a wearer's head, FIG. 2 is a view illustrating a state in which the head cradle shown in FIG. 1 is folded and is put around a wear's neck and FIG. 3 shows a view illustrating a folded shape and an unfolded shape of the head cradle shown in FIG. 1.

Referring to FIGS. 1 to 3, a head cradle 10 according to one embodiment of the present disclosure may be used for wearing a respiratory mask 1 which is a protective device that is pressed against a nose and mouth of a wearer to prevent the wearer from suctioning contaminants contained in a surrounding environment. The respiratory mask 1 may include a mask main body 20 which is in contact with the wearer's face to block contaminants flowing into the respiratory organ when the wearer wears the respiratory mask 1.

The mask main body 20 may be configured to cover the wearer's mouse and nose, and may include a protrusion portion to allow the wearer not to feel uncomfortable, straps 30 are connected to both sides of the mask main body 20 and the mask main body 20 is connected to the head cradle 10 through the straps 30.

In addition, the mask main body 20 may include a filter that may filter air inhaled into the wearer. For example, the mask main body 20 may include a filtration structure including one or more filtration layers and a support structure for supporting the filtration structure and maintaining a shape of the filtration structure. In this case, the filtration structure may be formed in the form of a sheet, and may take other various shapes and configurations.

Furthermore, the filtration structure may include a fluid-permeable surface region through which air may pass when the wearer inhales or exhales air.

In addition, the filtration structure may be a particle-capture filter or a gas and vapor filter. In some embodiments, the mask main body 20 may further include an expiratory valve (not shown) connected to the filtration structure to enable air exhaled by the wearer to be quickly removed from the interior of the mask, and this expiratory valve may be disposed at a central portion of the mask main body 20.

One end of the strap 30 may be connected to a side portion of the mask main body 20 and the other end thereof may be connected to the head cradle 10. In addition, the strap 30 may have elasticity so that the strap 30 may be stretched more than twice a total length when an external force is applied thereto and may be restored to a relaxed state when the external force is removed.

The straps 30 on both sides of the mask main body 20 each extend by a predetermined length and may be connected to the head cradle 10 on both sides of the wearer's head, at this time, a tension force is generated on the strap 30 by a restoring force of the strap 30 having the elasticity, and the mask main body 20 may be pressed against the wearer's face by the tension force of the strap 30 as described above.

For example, the strap 30 may have a length of about 25 to 60 cm, a width of 5 to 10 mm, and a thickness of 0.9 to 2.0 mm.

In addition, the strap 30 may be made of various materials such as thermosetting rubber, a thermoplastic elastomer, a braided or knitted yarn and rubber combination, an inelastic braided component, and the like.

Meanwhile, the head cradle 10 may include two head band members 100. Referring to FIG. 3, the two head band members 100 may be fastened to each other via a first fastening part 110 and a second fastening part 120 formed at end portions thereof. In other words, the first fastening part 110 provided at one of the hair band members 100 may be coupled to the second fastening part 120 provided at the other hair band member 100, and the second fastening part 120 provided at the one hair band member 100 may be coupled to the first fastening part 110 provided at the other hair band member 100. The two head band members 100 may be pivoted about the first and second fastening parts 110 and 120 by a predetermined angle to be folded or unfolded.

Accordingly, the head cradle 10 is worn on the wearer's head in a state in which the two head band members 100 constituting the head cradle 10 are unfolded so that the respiratory mask 1 may be fixed to the wearer's face, and when the wearer releases the wearing state of the head cradle 10, takes off and puts the respiratory mask 1 around his/her neck, it is possible to fold the two head band members 100 and to make the two head band members 100 easy to put around his/her neck.

Figure 4:
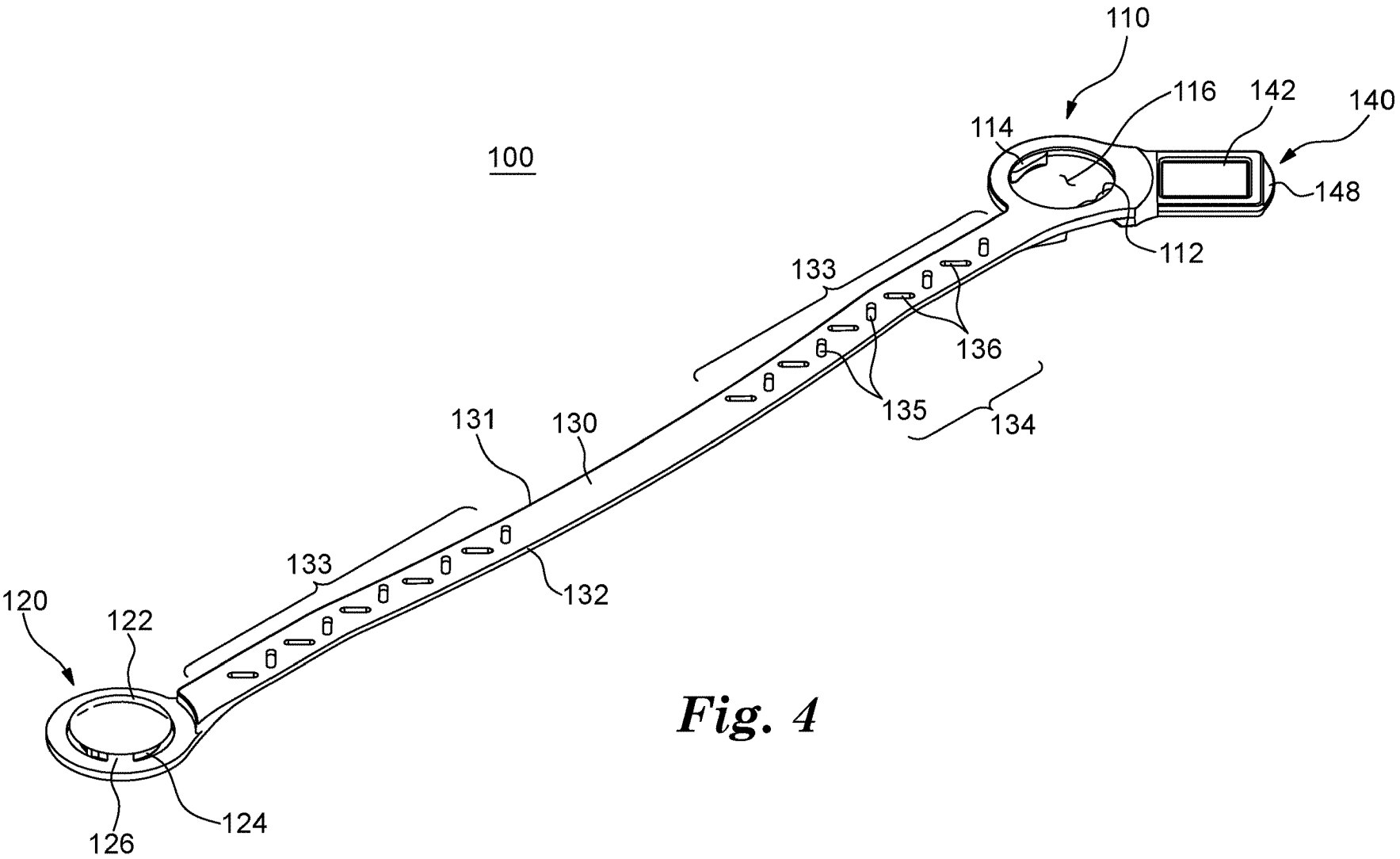
FIG. 4 is a perspective view illustrating a head band member shown in FIG. 1.
Figure 5:
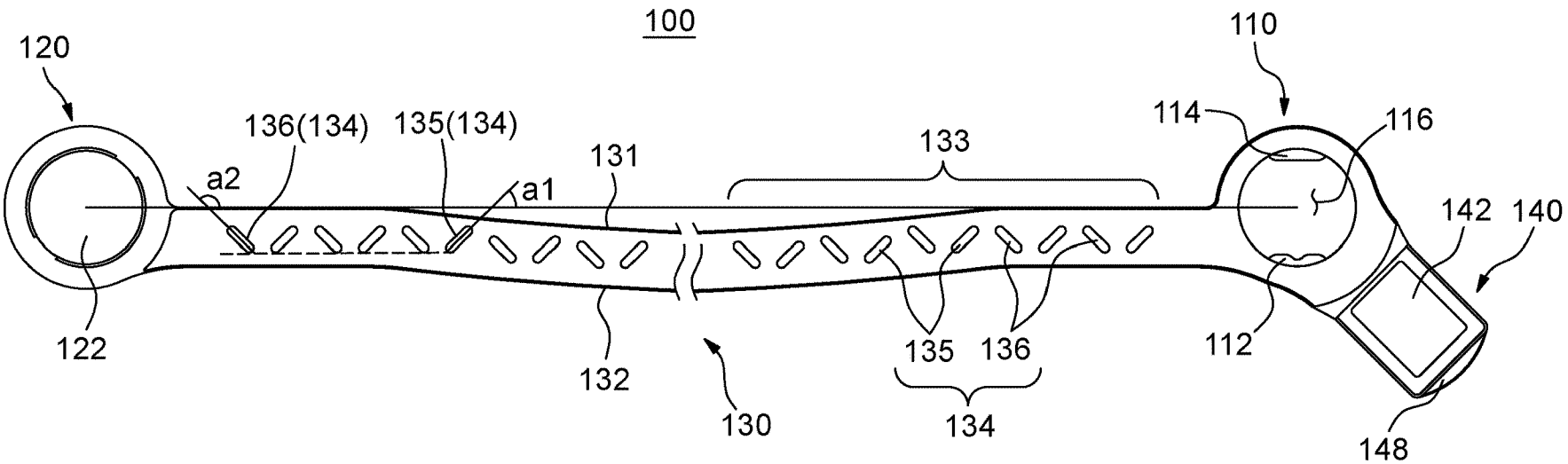
FIG. 5 is a plan view of the head band member shown in FIG. 5.
Figure 6:
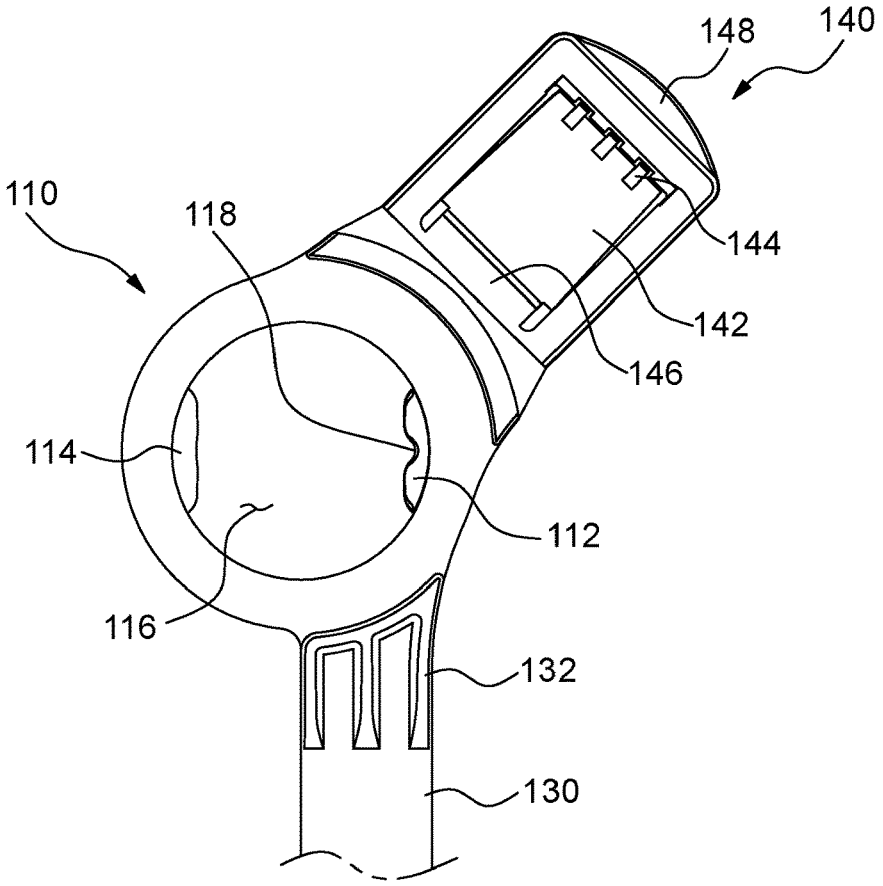
FIG. 6 is a view illustrating a first fastening part of the head band member shown in FIG. 1.
Figure 7:
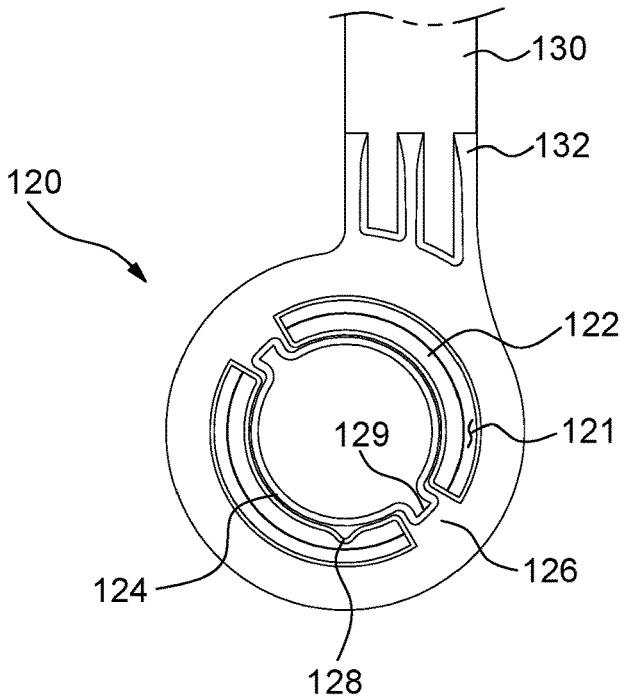
FIG. 7 is a view illustrating a second fastening part of the head band member shown in FIG. 1.

A specific structure of the head band member 100 will be described with reference to FIGS. 4 to 7. FIG. 4 is a perspective view illustrating the head band member shown in FIG. 1, FIG. 5 is a plan view of the head band member shown in FIG. 5, FIG. 6 is a view illustrating the first fastening end part of the head band member shown in FIG. 1, and FIG. 7 is a view illustrating the second fastening part of the head band member shown in FIG. 1.

Referring to FIGS. 4 to 7, the head band member 100 may include a support member 130 extending in one direction, the first fastening part 110 formed on one end portion of the support member 130, the second fastening part 120 formed on the other end portion of the support member 130, and a strap connection part 140 formed on an end portion of the first fastening part 110 or the second fastening part 120, wherein the strap 30 is connected to this strap connection part 140.

In addition, the head band member 100 may be made of a material having flexibility, may be made of, for example, a polymer-based plastic material having flexibility, and may have a flat shape having two opposite surfaces.

Specifically, the first fastening part 110 has a circular insertion hole 116 passing from one side surface of the first fastening part 110 to the other side surface thereof, and a click protrusion 112 and a stopper 114 may be formed to protrude from an inner circumferential surface of the insertion hole 116. In addition, the click protrusion 112 and the stopper 114 may protrude from both ends of the insertion hole 116 in a radial direction. However, this configuration is only one example, and the spirit of the present disclosure is not limited to the locations where the stopper 114 and the insertion hole 116 are formed.

The click protrusion 112 has an engagement groove 118 which is concavely formed on a surface thereof in the radial direction of the insertion hole 116. The engagement groove 118 may have a shape capable of receiving an engagement protrusion 128 protruding from a flexible ring 124 of the second fastening part 120.

In addition, each of the click protrusion 112 and the stopper 114 may have one inclined surface to have a shape that becomes thinner toward a center of the insertion hole 116. The above-described inclined surfaces formed on the click protrusion 112 and the stopper 114 may serve to help a cap 122 of the second fastening part 120 to softly enter the insertion hole 116 when the cap 122 is inserted into the insertion hole 116 of the first fastening part 110.

The insertion hole 116 and the cap 122 may be formed in a circular shape, and the cap 122 of the second fastening part 120 may be rotated in a state where the cap is inserted into the insertion hole 116. Accordingly, when the two head band members 100 are fastened to each other at both end portions, the two head band members 100 may be pivoted to fold or unfold with respect to each other. In this case, the two head band members 100 may be unfolded, for example, within an angular range of about 45°, but the spirit of the present disclosure is not limited to the above range.

The second fastening part 120 may include the cap 122 insertable into the insertion hole 116 of the first fastening part 110 and the flexible ring 124 protruding from one surface of such a 2). In addition, the flexible ring 124 is received in a circular hole 121 passing through both surfaces of the second fastening part 120, and the flexible ring 124 is connected to an inner circumferential surface of the circular hole 121 via a connection protrusion 126 having a shape protruding from the inner circumferential surface of the circular hole 121.

A surface opposite the surface of the cap 122 on which the flexible ring 124 is formed has a curved surface shape that becomes higher toward the center. When the cap 122 is inserted into the insertion hole 116, the curved surface comes into contact with the inclined surfaces of the stopper 114 and the engagement protrusion 128 and is slid along the inclined surfaces so that the first fastening part 110 and the and second fastening part 120 may be softly fastened to each other.

The flexible ring 124 is a ring-shaped member connected to the inner circumferential surface of the circular hole 121 via the connection protrusion 126 and is a member connecting the cap 122 and the inner circumferential surface of the circular hole 121 to each other. In addition, the flexible ring 124 has a ring shape and may have a shape connected to the inner circumferential surface of the circular hole 121 through the connection protrusions 126 at both ends in the radial direction.

Furthermore, the flexible ring 124 includes the engagement protrusion 128 formed to protrude from a point of an outer circumferential surface thereof, and a concaved groove 129 is formed on the connection protrusion 126 in the radial direction. Accordingly, when the first fastening part 110 and the second fastening part 120 are pivoted in a state in which the two fastening parts are fastened to each other, the engagement protrusion 128 is slid over the click protrusion 112. In this case, the flexible ring 124 may be elastically deformed by an interference between the click protrusion 112 and the engagement protrusion 128.

Specifically, in the flexible ring 124 formed of a flexible material, a portion which is preferably not connected to the connection protrusion 126 may extend or be contracted in the radial direction with a degree of freedom greater than or equal to a certain level. Further, when the flexible ring 124 is contracted, the concaved groove 129 formed on the connection protrusion 126 becomes narrower and the flexible ring 124 is more freely contracted, and when the engagement protrusion 128 is slid over the click protrusion 112, the flexible ring 124 may be contracted in the radial direction.

The contracted flexible ring 124 may be restored again when the engagement protrusion 128 is received in the engagement groove 118.

In addition, the engagement protrusion 128 may be formed in the vicinity of any one of the connection protrusions 126 formed at both ends in the radial direction of the flexible ring 124, and the engagement protrusion 128 may be formed at a location where the engagement groove 118 is located when the click protrusion 112 is received in the circular hole 121 to be pressed against one of the connection protrusions 126.

Accordingly, the two head band members 100 constituting the head cradle 10 may be pivoted with respect to each other until the stopper 114 and the click protrusion 112 are pressed against the connection protrusion 126 of the second fastening part 120, and the engagement protrusion 128 may be received in the engagement groove 118 when the pivot is completed.

Meanwhile, the support member 130 may have a band shape extending from the first fastening part 110 toward the second fastening part 120. The support member 130 may support the wearer's head when the head cradle 10 is worn on the wearer's head. The above-described support member 130 may include a hole-section 133 in which a slit hole 134 is formed, and the flexibility may be further enhanced by the slit hole 134.

The slit hole 134 may be a through hole passing through a main surface of the support member 130 in a thickness direction or a groove that is concaved in the main surface in the thickness direction. Here, the main surface refers to a surface facing the wearer's head. The slit hole 134 may have a slit shape extending lengthily and may be provided with a plurality of slit holes. The plurality of slit holes 134 may be arranged in a direction in which the support member 130 extends, but are preferably not formed on a central portion of the support member 130. In other words, the hole-sections 133 in which the slit holes 134 are formed are formed at the first fastening part 110 and the second fastening part 120 of the support member 130. Accordingly, when the head band member 100 is manufactured by an injection molding process using a mold, since the slit hole 134 is preferably not formed on the central portion of the support member 130, an inlet of the mold may be located at the central portion of the head band member 100.

When inlets of the mold are formed at both side end portions of the head band member 100, molding material injected from both sides forms a mold line at the central portion of the head band member 100, and thus the mold line increases an risk of occurrence of crack. However, when the inlet of the mold is provided at the central portion of the head band member 100 according to the present embodiment, since the molding material flows from the central portion toward both side end portions of the head band member 100, a mold line is preferably not formed, so that there is an effect of lowering the risk of occurrence of crack.

The slit hole 134 may be formed to be spaced apart from one thickness surface 131 and the other thickness surface 132 of the support member 130. Therefore, when the head band member 100 is manufactured by the injection molding process using the mold, even when one of a space between the slit hole 134 and the one thickness surface 131 of the support member 130 and a space between the slit hole 134 and the other thickness surface 132 of the support member 130 is blocked in the mold, the molding material may flow into the other space. Here, the one thickness surface 131 and the other thickness surface 132 of the support member 130 are defined as surfaces adjacent to the main surface of the support member 130.

The slit hole 134 may be formed to be inclined with respect to a direction in which the support member 130 extends. In addition, the slit hole 134 may include a first slit hole 135 and a second slit hole 136 having different slopes. In other words, when the first slit hole 135 is inclined such that one end portion of the first slit hole 135 corresponding to the first fastening part 110 faces the one thickness surface 131 of the support member 130 and the other end portion of the first slit hole 135 corresponding to the second fastening part 120 faces the other thickness surface 132 opposite the one thickness surface 131 of the support member 130, the second slit hole 136 may be inclined such that one end portion of the second slit hole 136 corresponding to the first fastening part 110 faces the other thickness surface 132 of the support member 130 and the other end portion of the second slit hole 136 corresponding to the second fastening part 120 faces the one thickness surface 131 of the support member 130.

Further, the first slit hole 135 and the second slit hole 136 may be disposed at symmetrical angles. For example, when an inclined angle a1 of the first slit hole 135 with respect to a direction extending from the first fastening part 110 toward the second fastening part 120 is approximately 45°, an inclined angle a2 of the second slit hole 136 with respect to the direction extending from the first fastening part 110 toward the second fastening part 120 may be approximately 135°. In addition, the first slit holes 135 and the second slit holes 136 may be alternately arranged. Therefore, when the head band member 100 is manufactured by the injection molding process using the mold, the molding material may effectively flow into the mold without generating vortex or forming pores.

Meanwhile, the strap connection part 140 may be provided at any one of the first fastening part 110 and the second fastening part 120. The strap connection part 140 may be formed to protrude from an outer circumferential surface of the first fastening part 110 or the second fastening part 120. In the embodiment, the configuration in which the strap connection part 140 is formed at the first fastening part 110 has been illustrated, but the spirit of the present disclosure is not limited thereto.

The strap connection part 140 is a portion to which the strap 30 connected to the mask main body 20 is connected and is provided to allow a length of the strap 30 to be adjustable as well as to be connected to the strap 30. Hereinafter, a detailed configuration of the strap connection part 140 will be described with reference to FIGS. 8 to 10.

Figure 8:
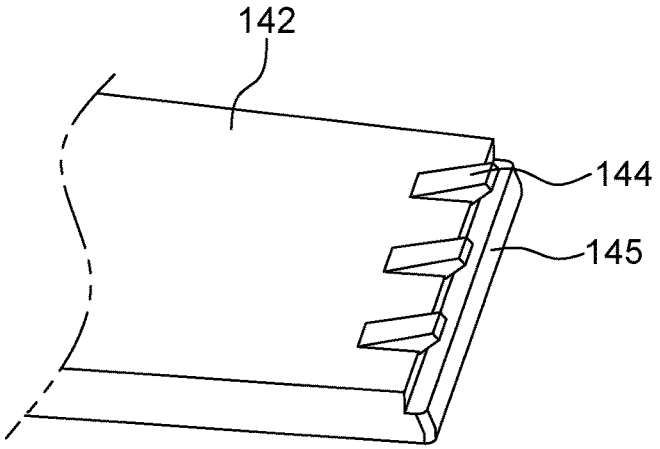
FIG. 8 is a view illustrating a strap-holding protrusion formed on a fixing piece of a strap connection part shown in FIG. 1.
Figure 9:
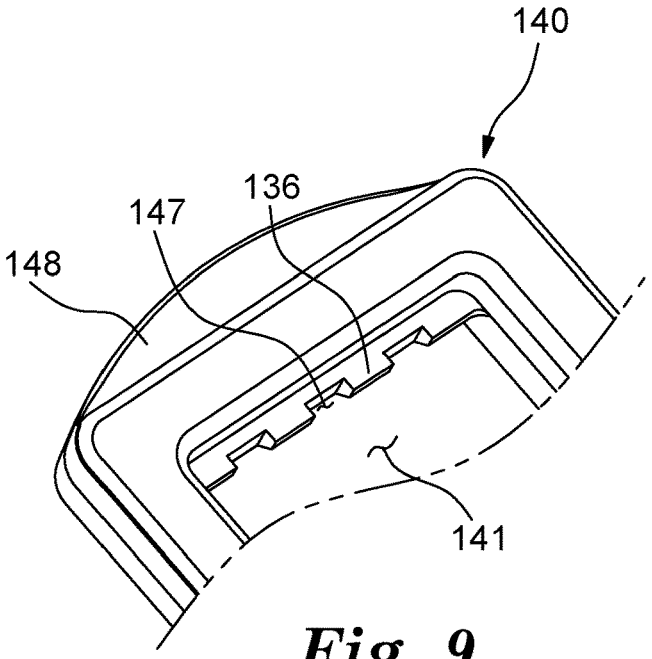
FIG. 9 is an enlarged view of an end portion of the strap connection part shown in FIG. 1.
Figure 10:
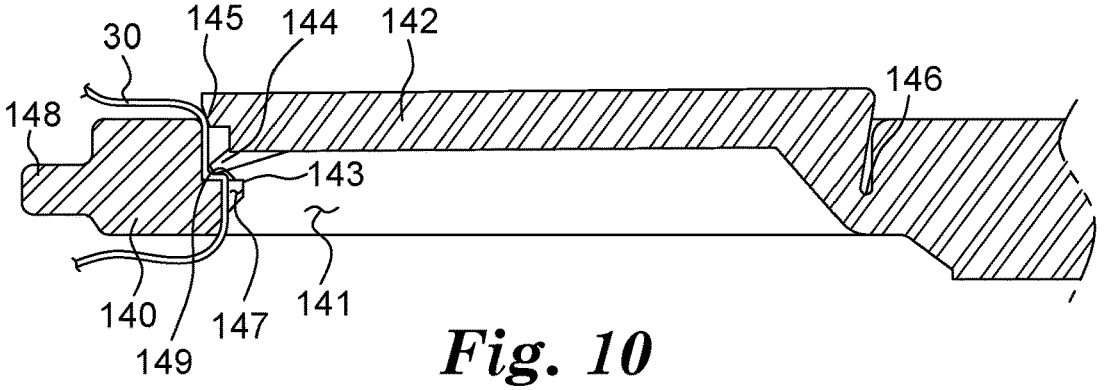
FIG. 10 is a cross-sectional view illustrating a cut-away shape of the strap connection part to which a strap in FIG. 1 is connected.

FIG. 8 is a view illustrating a strap-holding protrusion formed on a fixing piece of the strap connection part shown in FIG. 1, FIG. 9 is an enlarged view of an end portion of the strap connection part shown in FIG. 1, and FIG. 10 is a cross-sectional view illustrating a cut-away shape of the strap connection part to which the strap in FIG. 1 is connected.

Referring to FIGS. 8 to 10, a strap connection hole 141 in a rectangular shape is formed in the strap connection part 140, and the strap connection part 140 may include a fixing piece 142 having a rectangular cross-section and connected to a side wall forming the strap connection hole 141 via a hinge 146. In addition, a step portion 143 may be formed to protrude inward from the other side wall of the strap connection hole 141, and an end portion 145 of the fixing piece 142 is selectively in contact with this step portion 143.

The fixing piece 142 is pivoted about the hinge 146 in a state in which the end portion 145 is in contact with a stepped surface 149 of the step portion 143 so that the fixing piece 142 may protrude to the outside of the strap connection hole 141. Accordingly, in order to pass an end portion of the strap 30 through the strap connection hole 141, the wearer may pivot the fixing piece 142 to form a gap between the fixing piece 142 and the step portion 143. In this state, by pushing the end portion of the strap 30 into the gap and passing the strap 30 through the strap connection hole 141, the wearer may connect the strap 30 to the strap connection part 140.

The strap 30 passed through the strap connection hole 141 as described above may be engaged with the end portion 145 of the fixing piece 142 by the step portion 143 to hold a position with respect to the head band member 100. More specifically, one or more strap-holding protrusions 144 protruding from the end portion 145 of the fixing piece 142 may be engaged with one or more strap-holding grooves 147 formed in the step portion 143 by pressure by which the strap-holding protrusion 144 is inserted into the strap-holding groove 147.

To this end, at a location of the step portion 143 corresponding to the strap-holding protrusion 144, the strap-holding groove 147 may be concavely formed in a surface facing the inside of the strap connection hole 141. In addition, the strap-holding protrusion 144 may be formed to have a thickness corresponding to a width of the strap-holding groove 147.

In this case, a pressure for holding the strap 30 may be applied to the strap 30 by transmitting a restoring force (torque) generated at the hinge 146 to the end portion 145 of the fixing piece 142.

Further, the strap-holding protrusion 144 may be formed to be inclined downward at a predetermined angle with respect to a surface of the fixing piece 142 facing the stepped surface 149 of the step portion 143. Due to the above configuration, when the strap 30 is held, the pressure for holding the strap 30 is effectively transmitted to the strap 30 so that the strap 30 may be tightly engaged by the strap-holding protrusion 144 and the strap-holding groove 147. As a result, a holding location of the strap 30 may be maintained well.

In addition, when the wearer desires to adjust a length of the strap 30, the wearer pulls a portion of the strap 30 that is passed in a direction opposite a direction in which the strap-holding protrusion 144 protrudes so that the strap 30 is slid along an inclined surface of the strap-holding protrusion 144. Therefore, it is possible to easily adjust the length of the strap 30 in spite of the holding pressure applied to the strap 30.

In this case, the wearer may easily pull the strap 30 in a state in which an end portion 148 of the strap connection part 140 is fixed with a hand.

In addition, when the wearer desires to adjust the length of the strap 30 in an opposite direction, in a state in which the fixing piece 142 is pivoted by a hand to form a gap between the end portion 145 of the fixing piece 142 and the step portion 143, the wearer may pull the strap 30 in the opposite direction to adjust the length of the strap.

Hereinafter, the operation and effect of the head band member 100 and the head cradle 10 according to the present embodiment having the above-described configuration will be described with reference to FIGS. 11 to 14.

Figure 11:
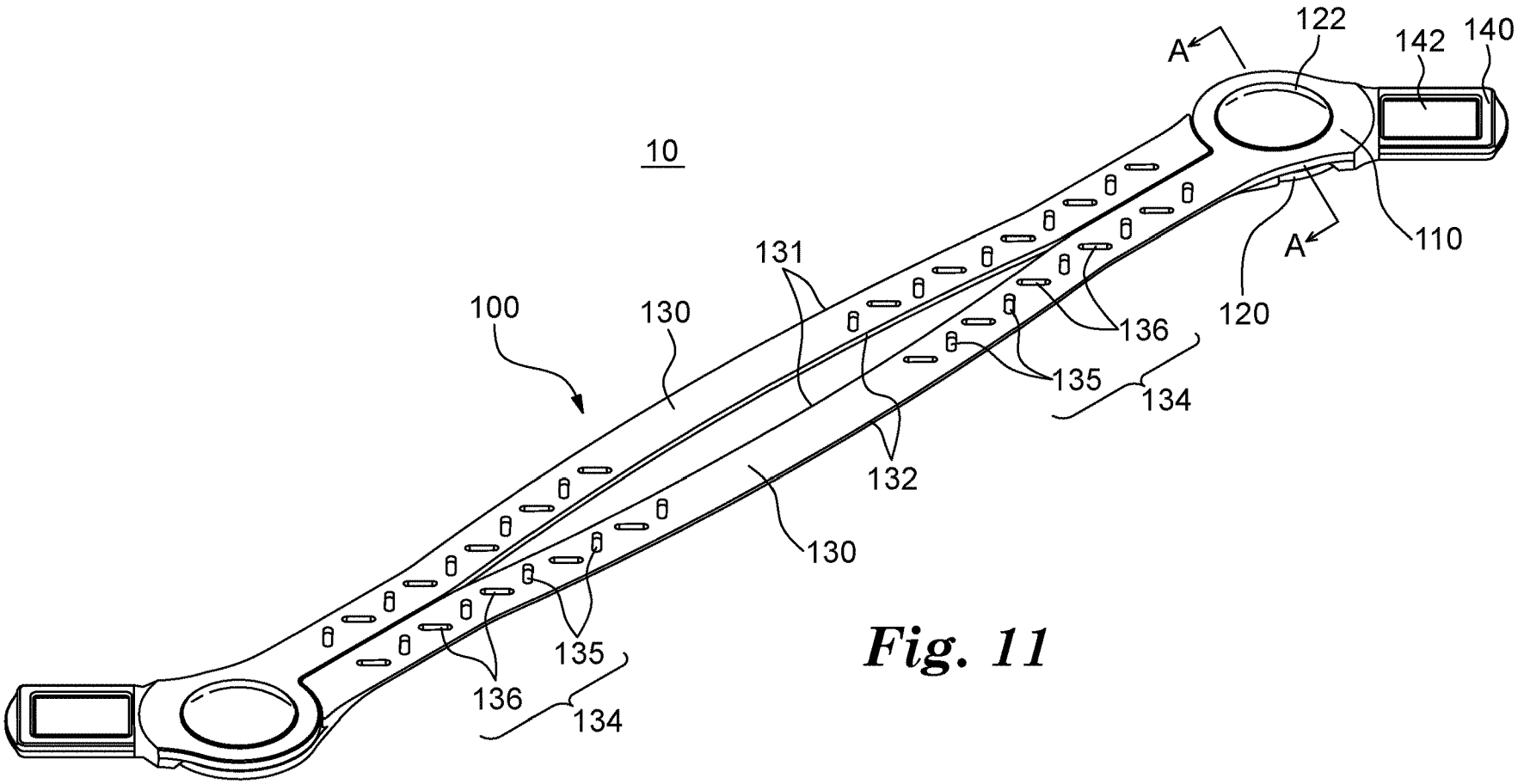
FIG. 11 is a perspective view illustrating a state in which two head band members in FIG. 1 are fastened to form the head cradle.
Figure 12:
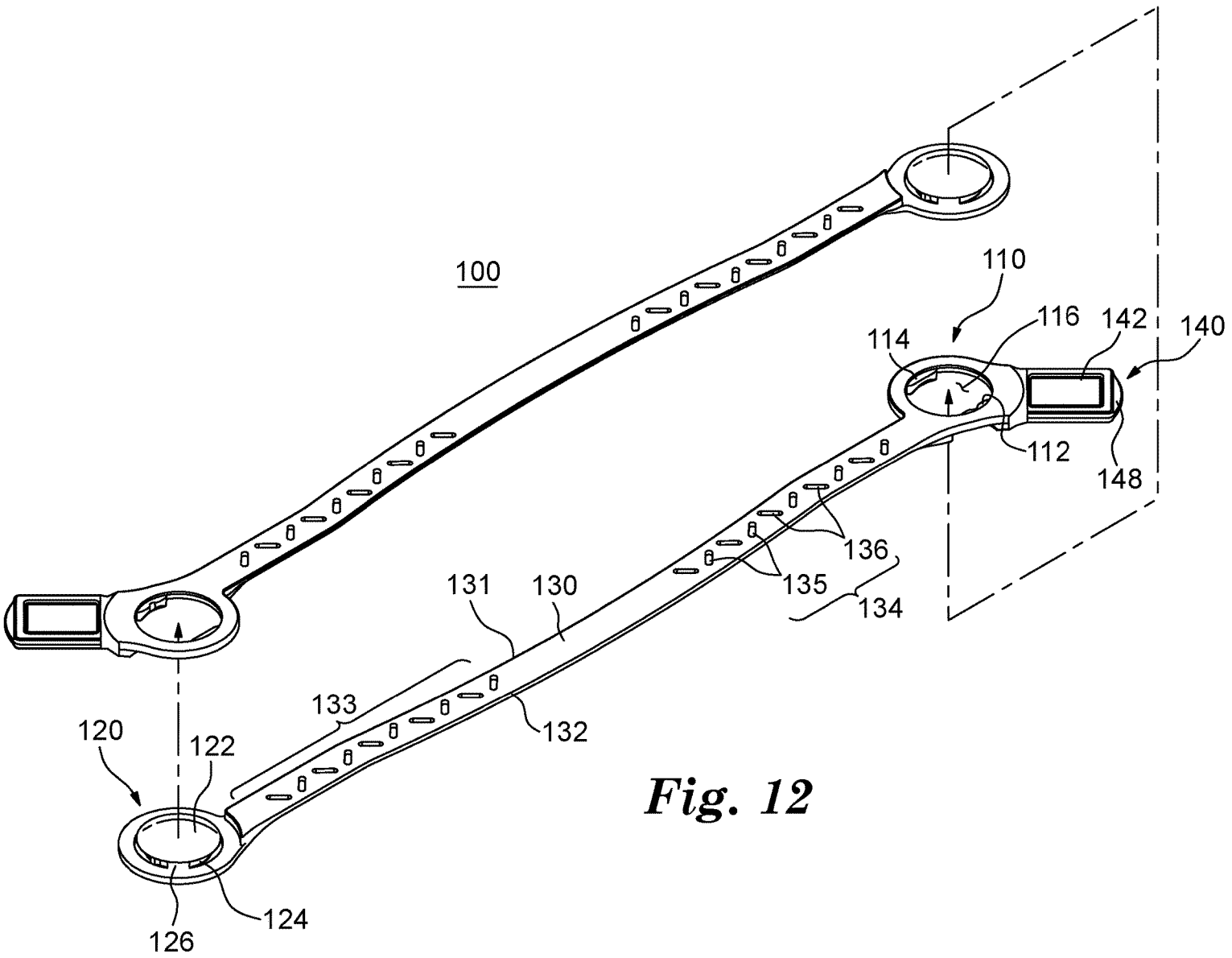
FIG. 12 is an exploded perspective view of the head cradle shown in FIG. 11.
Figure 13:
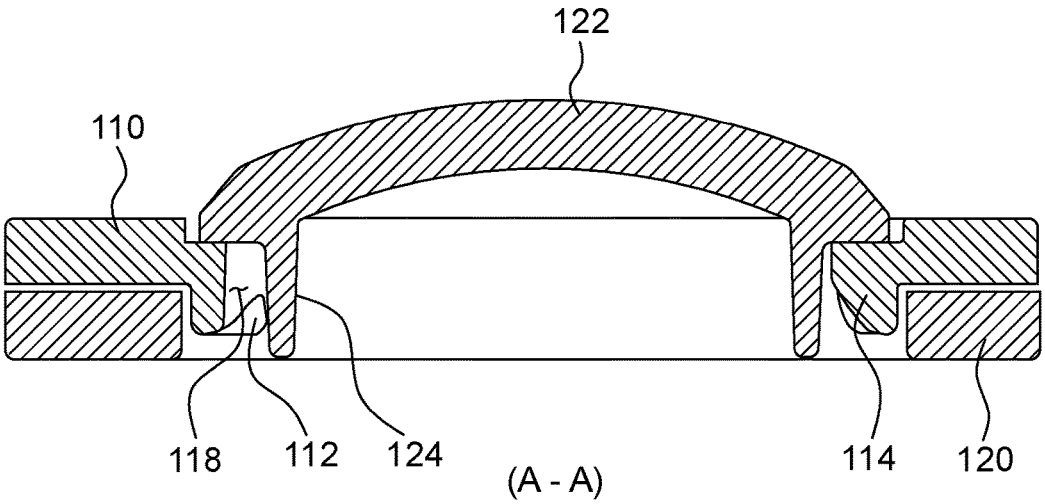
FIG. 13 is a cross-sectional view taken along line A-A of FIG. 11.
Figure 14:
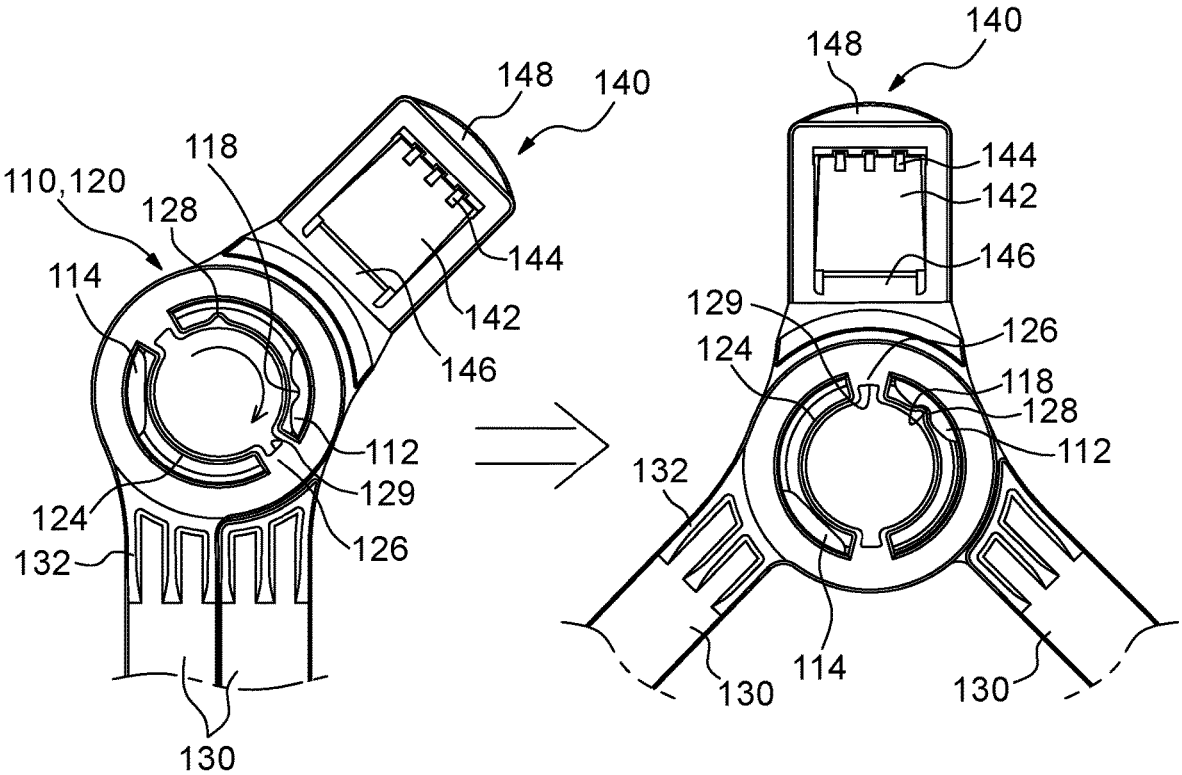
FIG. 14 is a view illustrating a state in which the first fastening part of one head band member of two head band members of the head cradle shown in FIG. 1 and the second fastening part of the other head band member are fastened to each other and rotated with respect to each other.

FIG. 11 is a perspective view illustrating a state in which the two head band members in FIG. 1 are fastened to form the head cradle, FIG. 12 is an exploded perspective view of the head cradle shown in FIG. 11, FIG. 13 is a cross-sectional view taken along line A-A of FIG. 11, and FIG. 14 is a view illustrating a state in which the first fastening part of one head band member of two head band members of the head cradle shown in FIG. 1 and the second fastening part of the other head band member are fastened to each other and rotated with respect to each other.

Referring to FIGS. 11 to 14, the head cradle 10 according to one embodiment of the present disclosure is configured by fastening the two head band members 100 to each other. In this case, the first fastening part 110 of one of the two head band members 100 may be fastened to the second fastening part 120 of the other head band member, and the first fastening part 110 of the other head band member may be fastened to the second fastening part 120 of the one head band member.

When the first fastening part 110 and the second fastening part 120 are fastened to each other, the cap 122 of the second fastening part 120 may be inserted into the insertion hole 116 of the first fastening part 110. In this case, as the cap 122 begins to enter the insertion hole 116, one surface of the cap 122 is partially interfered by the click protrusion 112 and the stopper 114 of the first fastening part 110. When a force is continuously applied to the flexible cap 122 in an entry direction, a shape of the flexible cap 122 is deformed, and a surface of the cap 122 which is in contact with the click protrusion 112 and the stopper 114 is slid over the inclined surfaces formed on the click protrusion 112 and the stopper 114.

When an insertion of the cap 122 is completed through the above process, a state in which the cap 122 is engaged with the click protrusion 112 and the stopper 114 is maintained so that the cap 122 is prevented from escaping from the insertion hole 116 in a direction opposite the insertion direction, and the fastening of the first fastening part 110 and the second fastening part 120 may be completed.

In addition, at least a portion of the cap 122 may be received in the insertion hole 116 in a state in which the fastening of the first fastening part 110 and the second fastening part 120 is completed. Accordingly, a rotation of the cap 122 may be guided by the inner circumferential surface of the insertion hole 116 when the cap 122 is rotated in the insertion hole 116.

A process of unfolding or folding the head cradle 10 performed by mutually pivoting the two head band members 100 fastened through the above-described process will be described below.

As illustrated in FIG. 14, in a folded state of the head cradle 10 in which the cap 122 is received in the insertion hole 116, a state in which the engagement protrusion 128 of the flexible ring 124 is preferably not received in the engagement groove 118 may be maintained. When the head cradle 10 is unfolded from the folded state, the first fastening part 110 and the second fastening part 120 are pivoted with respect to each other and the flexible ring 124 is rotated in the insertion hole 116 of the first fastening part 110.

When the flexible ring 124 is continuously rotated and the engagement protrusion 128 is then brought into contact with the click protrusion 112, a rotation of the flexible ring 124 is interfered. In this case, when a rotational force is continuously applied, the flexible ring 124 is contracted in a radial direction, and the engagement protrusion 128 is slid over the click protrusion 112 and is then received in the engagement groove 118. In this process, the engagement protrusion 128 is slid over the click protrusion 112 and is abruptly received in the engagement groove 118 to collide with the click protrusion 112. In this case, clicking sound caused by the above collision is generated to transmit a sense of click to the wearer.

When the engagement protrusion 128 is received in the engagement groove 118, the stopper 114 and the click protrusion 112 are interfered by the connection protrusion 126 of the second fastening part 120 and the flexible ring 124 is prevented from being further rotated.

Through this process, the wearer may easily unfold the head cradle 10 and recognize completion of the unfolding of the head cradle 10 through the transmitted sense of click. In a state in which the head cradle 10 is unfolded, the unfolded state may be maintained by the engagement protrusion 128 received in the engagement groove 118.

Meanwhile, the strap connection part 140 may be formed to extend at a predetermined angle with respect to an extension direction of the support member 130. For example, the strap connection part 140 may extend in a direction deviating from a direction in which the support member 130 extends, and may be formed to have a deviating angle of 45° or 135°. In this case, when the head cradle 10 is unfolded, the strap connection part 140 and the two support members 130 may be unfolded in a symmetrical shape. In addition, as illustrated in FIG. 14, when the head cradle 10 is fully unfolded, the two support members 130 may be symmetrical with respect to an imaginary center line of the strap connection part 140.

Accordingly, when the head cradle 10 is worn on the wearer's head, the strap connection part 140 may be disposed in a direction toward the mask main body 20 and the strap 30 may extend in an extension direction of the strap connection part 140 to be connected to the mask main body 20. Thus, when the wearer tries to adjust the length of the strap 30, there is no need to make an effort to align the extension direction of the strap 30 and the extension direction of the strap connection part 140.

When the head cradle 10 is folded, the support members 130 of the two head band members 100 are maintained in an approximately horizontal state. However, when the head cradle 10 is unfolded, the central portions of the support members 130 become distant from each other, and both end portions of the support members 130 where the respective fastening parts 110 and 120 are located become close to each other, so that the support members 130 are bent in one direction. In this case, the support members 130 may be guided to be bent only in a constant direction at all times. This may be obtained by a reinforcement part 132 formed on the same plane at a point at which the support members 130 are connected to the two fastening parts 110 and 120.

Specifically, the reinforcement part 132 is formed at a location where the first and second fastening parts 110 and 120 and the support member 130 are connected to each other, and may be thrilled in a shape in which a thickness is reduced in a direction from the first and second fastening parts 110 and 120 toward the support member 130. Further, the reinforcement part 132 may be formed on a surface opposite a surface from which the cap 122 protrudes. Accordingly, when the head cradle 10 is unfolded, the head band member 100 may be bent so that the surfaces on which the reinforcement parts 132 are formed face each other, and the head cradle 10 may be unfolded so that the direction in which the cap 122 protrudes faces outward.

The head cradle 10 unfolded as described above is worn on the wearer's head in a state of being connected to the mask main body 20 through the strap 30 to enable the mask main body 20 fixed to the wearer's face to be maintained.

Meanwhile, the wearer may fold the head cradle 10 to put the respiratory mask 1 around his/her neck. In this case, the wearer may pivot the two head band members 100 in a direction opposite a direction in which the two head band members 100 are unfolded, to fold the head cradle. In this case, the engagement protrusion 128 received in the engagement groove 118 may slide over the click protrusion 112 again to transmit the sense of click to the wearer.

According to the head band member 100 and the head cradle 10 of the embodiment as described above, sine the head cradle 10 can be made by fastening two head band members 100 having the same shape, a manufacturing process is simple as compared with a conventional head cradle including two members having different shapes, and when the mask main body 20 is worn on a face, since the support member 130 is bent in a state in which the head cradle 10 is unfolded at a predetermined angle, it is possible to transmit a feeling that the head cradle is stably fixed to the wearer's head to the wearer.

Further, since it is possible to transmit a soft click sense caused by an interaction between the click protrusion 112 and the engagement protrusion 128 at the time of folding or unfolding the head cradle 10 for wearing or putting the mask on a face or around a neck, the problems that a conventional head cradle transmits a rattling feeling to the wearer and preferably does not provide the wearer with a soft click sense at the time of wearing the head cradle can be solved.

In addition, even when the two head band members 100 are repeatedly folded and unfolded for a long time after being fastened once, since an engagement state is maintained by the stopper 114 and the click protrusion 112 in the state in which the cap 122 is received in the insertion hole 116 and both elements are preferably not easily separated from each other, the use lifetime of the product can be extended as compared with the conventional product.

Meanwhile, it may be necessary to wear the respiratory mask 1 and a helmet at the same time at a dangerous work site. In this case, according to the above-described embodiment, since the strap 30 is directly connected to the head cradle 10, the wearer has to wear a helmet on the head cradle 10 in a state in which the head cradle 10 is worn on the wearer's head. Accordingly, the head cradle 10 and the helmet are overlappingly worn together, which causes the wearer's head to be pressed more than necessary, and this makes the wearer feel uncomfortable. Furthermore, since the helmet may not be pressed against the wearer's head, there may be a problem that when an impact is exerted to the head, the helmet may not perform a proper shock-absorbing function.

In order to solve the above-described problems, a second embodiment of the present disclosure described below is proposed. Hereinafter, a head band member and a head cradle including the same according to the second embodiment of the present disclosure will be described with reference to FIGS. 15 and 16.

Figure 15A:
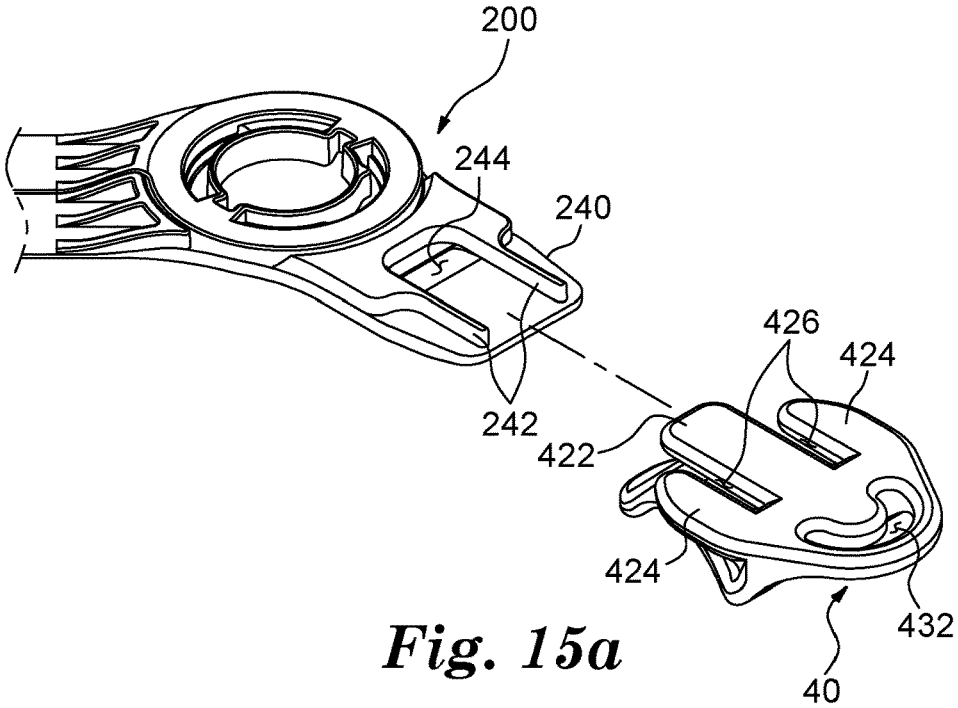
FIGS. 15*a* and 15*b* are views according to a second embodiment of the present disclosure in which a head cradle is being fastened and is fastened to a buckle for connecting a strap
Figure 15B:
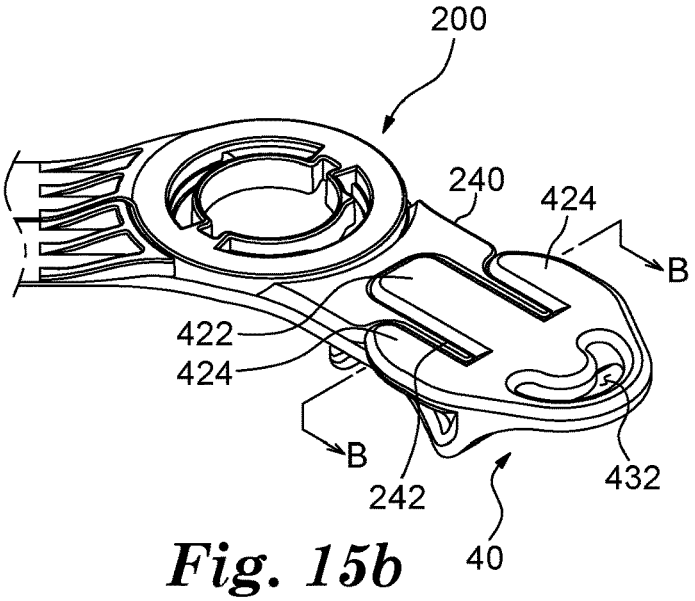
Figure 16:
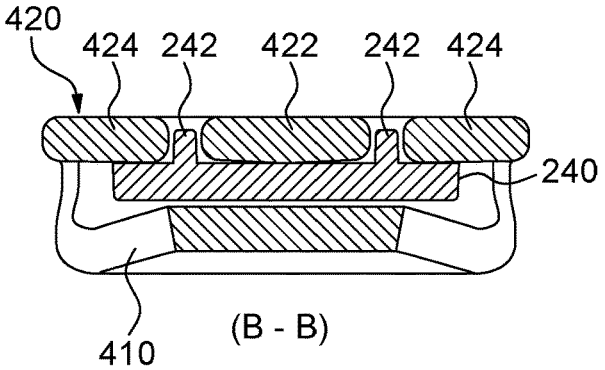
FIG. 16 is a cross-sectional view taken along line B-B of FIG. 15*a*.

FIG. 15 is a view illustrating a state in which the head cradle according to the second embodiment of the present disclosure is fastened to a buckle for connecting a strap, and FIG. 16 is a cross-sectional view taken along line B-B of FIG. 15.

Referring to FIGS. 15 and 16, in a head band member 200 according to the second embodiment of the present disclosure, a strap connection part 240 may have a shape which differs from that of the strap connection part 140 in the above-described embodiment and may have a structure connected to the strap 30 via a buckle 40 separately provided. Such differences will be mainly described below, and the above-described embodiment will be recited for describing the same description and reference numerals as in the above description.

The head cradle 10 including the head band member 200 according to the present embodiment is pressed against the wearer's head to enable the mask main body 20 connected thereto via the buckle 40 and the strap 30 to be pressed against and maintained on the wearer's face.

To this end, the strap connection part 240 has a structure that may be fastened to the buckle 40. Specifically, the strap connection part 240 may include a protrusion member 242 protruding from one surface thereof, and the protrusion member 242 is formed at a location corresponding to a fastening groove 426 of the buckle 40 and has a shape corresponding to that of the fastening groove 426. In this case, the protrusion member 242 may be formed to have the same thickness as a width of the fastening groove 426 in a direction extending on the one surface of the strap connection part 240.

For example, two protrusion members 242 may be formed in accordance with the two fastening grooves 426 formed on an engagement part 420 of the buckle 40, and a central engagement member 422 of the engagement part 420 may enter a space between the two protrusion members 242. That is, when the buckle 40 is fastened to the engagement part 420, the protrusion member 242 is inserted into the fastening groove 426 so that a relative location of the buckle 40 with respect to the strap connection part 240 may be fixed.

In addition, the strap connection part 240 may include a latching hole 244 formed therein to enable a latching protrusion (not shown) protruding from a lower surface of the central engagement member 422 to be received when the buckle 40 is fastened to the strap connection part 240.

A process of fastening the buckle 40 to the strap connection part 240 is described as below. When the buckle 40 approaches the strap connection part 240 while being held by the wearer, the latching protrusion of the buckle 40 is brought in contact with the one surface of the strap connection part 240 and starts to move forward, and the central engagement member 422 may enter a space between the protrusion members 242 while an opening of the buckle 40 is widened due to flexibility of the buckle 40.

When the buckle 40 is continuously moved forward toward the strap connection part 240 and the latching protrusion is received in the latching hole 244, a latching part 410 of the buckle 40, which is bent to widen the opening of the buckle 40 is restored to allow the latching protrusion to be caught on a side wall constituting the latching hole 244. In other words, the latching protrusion is received in the latching hole 244, and an inner wall of the latching protrusion is brought into contact with the side wall of the latching hole 244.

Accordingly, the process of fastening the buckle 40 to the strap connection part 240 may be completed, and the protrusion member 242 is received in the fastening groove 426 and the latching protrusion is simultaneously received in the latching hole 244 so that a fastening state of the buckle 40 with respect to the strap connection part 240 may be maintained.

As described above, since the wearer may simply move the buckle 40 forward toward the strap connection part 240 to fasten the buckle 40 to the strap connection part 240, it is possible to easily fasten the buckle 40 and to wear the mask main body 20 on the face in a state in which the strap connection part 240 is worn on the head.

In addition, even when the fastening between the buckle 40 and the strap connection part 240 is released in order to take off the head cradle 10, the wearer pulls the latching part 410 to artificially widen the opening of the buckle 40 and moves the buckle 40 in a direction opposite the direction in which the buckle is moved forward at the time of fastening so that it is possible to easily separate the buckle 40 from the strap connection part 240. Accordingly, when the wearer wants to replace the head cradle 10 with a helmet in a state in which the head cradle 10 is being worn, the wearer separates the buckle 40 first and takes off the head cradle 10, and then wears a helmet on his/her head, and the wearer fastens the buckle 40 to the helmet again to enable the mask main body 20 to be connected to the helmet, so that the embodiment is advantageous in that it is possible to easily replace the head cradle 10 with a helmet.

The followings are the list of embodiments of the present disclosure.

Item 1 is the head cradle including two head band members fastened to each other, wherein the head band member includes a support member extending in one direction; a first fastening part formed at one end portion of the support member and having an insertion hole formed to pass therethrough; a second fastening part formed at the other end portion of the support member; and a strap connection part which is formed at an end portion of the first fastening part or the second fastening part and to which a strap connected to a mask main body is connected, and the support member includes a hole-section in which at least one slit hole having a shape extending at a predetermined angle with respect to the one direction is formed.

Item 2 is the head cradle in which the slit hole has a shape extending in a direction deviating from the one direction.

Item 3 is the head cradle in which the slit hole is provided with a plurality of slit holes, first slit holes of the plurality of slit holes have a shape extending at a predetermined angle with respect to the one direction and second slit holes of the plurality of slit holes have a shape extending at an angle which differs from the angle at which the first slit hole extends.

Item 4 is the head cradle in which the first slit holes and the second slit holes are alternately disposed in the one direction.

Item 5 is the head cradle in which the hole-section is provided at each of the first fastening part and the second fastening part, and a region in which the first slit hole and the second slit hole included in the hole-section are preferably not formed, and in some embodiments not formed, is formed at a central portion of the support member.

Item 6 is the head cradle in which the first slit hole and the second slit hole are inclined at symmetrical angles.

Item 7 is the head cradle in which at least a portion of the second fastening part of one of the two head band members is inserted into the insertion hole of the first fastening part of the other one to fasten the first and second fastening parts, at least a portion of the second fastening part of the other one is inserted into the insertion hole of the first fastening part of the one to fasten the first and second fastening parts, and the two head band members are pivoted at a predetermined angle about the first fastening part and the second fastening part to be unfoldable or foldable again in a unfolded state.

Item 8 is the head cradle in which the first fastening part includes a click protrusion formed to protrude from an inner circumferential surface of the insertion hole.

Item 9 is the head cradle in which the second fastening part includes a cap having a shape insertable into the insertion hole; and a flexible ring protruding from one surface of the cap, received in a circular hole passing through the second fastening part, and connected to an inner circumferential surface of the circular hole via a connection protrusion protruding from the inner circumferential surface of the circular hole, and the first fastening part and the second fastening part are fastened to each other by inserting the cap into the insertion hole.

Item 10 is the head cradle in which at least a portion of the cap is placed in the insertion hole when the cap is inserted into the insertion hole to allow the cap to be guided and rotated by the insertion hole when the second fastening part is rotated about the first fastening part.

Item 11 is the head cradle in which the first fastening part further includes a stopper protruding from an inner circumferential surface opposite the click protrusion in a radial direction, the cap is formed in a curved surface shape in which a surface opposite a surface on which the flexible ring is formed becomes higher toward a center, and the click protrusion and the stopper include inclined surfaces over which a second surface is slid when the cap is inserted into the insertion hole.

Item 12 is the head cradle in which when the cap is inserted into the insertion hole, the cap is prevented from being separated in a direction opposite an insertion direction by the click protrusion and the stopper.

Item 13 is the head cradle in which the flexible ring includes an engagement protrusion formed to protrude from a point of an outer circumferential surface thereof, the click protrusion has an engagement groove formed to receive the engagement protrusion, and the connection protrusion has a concaved groove formed in a radial direction.

Item 14 is the head cradle in which the strap connection part includes a fixing piece connected to one side wall of a strap connection hole and a step portion that is selectively in contact with an end portion of the fixing piece is formed to protrude from the other side wall of the strap connection hole.

Item 15 is the head cradle in which the strap connection part has at least one strap-holding groove which is concavely formed in the step portion, and the fixing piece includes a strap-holding protrusion formed at a location corresponding to the strap-holding groove and protruding from a surface facing a stepped surface thereof.

Item 16 is the head cradle in which the strap-holding protrusion is formed to be inclined with respect to a surface facing the stepped surface of the fixing piece.

Item 17 is the head cradle in which the strap connection part is formed to extend in a direction deviating by a predetermined angle from a direction in which the support member extends to allow the two fastened support members to be symmetrical with respect to an imaginary center line of the strap connection part when the head cradle is fully unfolded.

Item 18 is the head cradle in which the strap connection part is connected to the strap via a buckle to which the strap is connected at one side.

Item 19 is the head cradle in which the strap connection part includes a protrusion member protruding from one surface thereof, and the buckle has a fastening groove formed to have a shape corresponding to that of the protrusion member to allow the protrusion member to be inserted into the fastening groove for fastening the strap connection part to the buckle.

Although the head band member having the excellent flexibility and the head cradle including the same according to the present disclosure have been described as specific embodiments, the embodiments are merely examples, the present disclosure is not limited thereto, and it should be understood that the embodiments have the broadest scope in accordance with the basic spirit disclosed in the specification. Those skilled in the art may combine/replace the disclosed embodiments to implement patterns of shapes that are not included in the detail description, but they also do not depart from the scope of the present disclosure. In addition, those skilled in the art can easily change or modify the disclosed embodiments on the basis of the specification, and it is apparent that such changes or modifications are also included within the scope of the present disclosure.

What is claimed is:

1. A head cradle comprising two head band members fastened to each other, wherein the head band member comprises:

a support member extending in one direction;

a first fastening part formed at one end portion of the support member and having an insertion hole formed to pass therethrough;

a second fastening part formed at the other end portion of the support member; and a strap connection part which is formed at an end portion of the first fastening part or the second fastening part and to which a strap connected to a mask main body is connected, wherein the support member comprises a hole-section in which at least one slit hole having a shape extending at a predetermined angle with respect to the one direction is formed and wherein at least a portion of the second fastening part of one head band member of the two head band members is inserted into the insertion hole of the first fastening part of the other head band member thereof to fasten the first and second fastening parts, at least a portion of the second fastening part of the other head band member is inserted into the insertion hole of the first fastening part of the one head band member to fasten the first and second fastening parts; and the two head band members are pivoted at a predetermined angle about the first fastening part and the second fastening part to be unfoldable or foldable again in an unfolded state.

2. The head cradle of claim 1, wherein the slit hole has a shape extending in a direction deviating from the one direction.

3. The head cradle of claim 1, wherein:

the slit hole is provided with a plurality of slit holes;

a first slit hole among the plurality of slit holes has a shape extending at a predetermined angle with respect to the one direction; and a second slit hole among the plurality of slit holes has a shape extending at an angle which differs from the angle at which the first slit hole extends.

4. The head cradle of claim 3, wherein the first slit hole and the second slit hole are alternately disposed in the one direction.

5. The head cradle of claim 3, wherein:

the hole-section is provided at each of the first fastening part and the second fastening part; and a region in which the first slit hole and the second slit hole included in the hole-section are not formed is formed at a central portion of the support member.

6. The head cradle of claim 3, wherein the first slit hole and the second slit hole are inclined at symmetrical angles.

7. The head cradle of claim 1, wherein the first fastening part comprises a click protrusion formed to protrude from an inner circumferential surface of the insertion hole.

8. The head cradle of claim 7, wherein the second fastening part comprises:

a cap having a shape insertable into the insertion hole; and a flexible ring configured to protrude from one surface of the cap, configured to pass through the second fastening part to be received in a circular hole, and connected to an inner circumferential surface of the circular hole via a connection protrusion protruding from the inner circumferential surface of the circular hole, wherein the first fastening part and the second fastening part are fastened to each other by inserting the cap into the insertion hole.

9. The head cradle of claim 8, wherein at least a portion of the cap is positioned in the insertion hole when the cap is inserted into the insertion hole to allow the cap to be guided and rotated by the insertion hole when the second fastening part is rotated about the first fastening part.

10. The head cradle of claim 8, wherein:

the first fastening part further comprises a stopper protruding from an inner circumferential surface opposite the click protrusion in a radial direction;

the cap is formed in a curved surface shape in which a surface opposite a surface on which the flexible ring is formed becomes higher toward a center; and the click protrusion and the stopper comprise inclined surfaces over which a second surface is slid when the cap is inserted into the insertion hole.

11. The head cradle of claim 10, wherein, when the cap is inserted into the insertion hole, the cap is prevented from being separated in a direction opposite an insertion direction by the click protrusion and the stopper.

12. The head cradle of claim 8, wherein:

the flexible ring comprises an engagement protrusion formed to protrude from a point of an outer circumferential surface thereof;

the click protrusion has an engagement groove formed to receive the engagement protrusion; and the connection protrusion has a concaved groove formed in a radial direction.

13. The head cradle of claim 1, wherein:

the strap connection part comprises a fixing piece connected to one side wall of a strap connection hole; and a step portion selectively in contact with an end portion of the fixing piece is formed to protrude from the other side wall of the strap connection hole.

14. The head cradle of claim 13, wherein:

the strap connection part has at least one strap-holding groove concavely formed in the step portion; and the fixing piece comprises a strap-holding protrusion formed at a location corresponding to the strap-holding groove and protruding from a surface facing a stepped surface thereof.

15. The head cradle of claim 14, wherein the strap-holding protrusion is formed to be inclined with respect to a surface facing the stepped surface of the fixing piece.

16. The head cradle of claim 1, wherein the strap connection part is formed to extend in a direction deviating by a predetermined angle from a direction in which the support member extends to allow the two fastened support members to be symmetrical with respect to an imaginary center line of the strap connection part when the head cradle is fully unfolded.

17. The head cradle of claim 1, wherein the strap connection part is connected to the strap via a buckle to which the strap is connected at one side.

18. The head cradle of claim 17, wherein the strap connection part comprises a protrusion member protruding from one surface thereof, and the buckle has a fastening groove formed to have a shape corresponding to that of the protrusion member to allow the protrusion member to be inserted into the fastening groove for fastening the strap connection part to the buckle.

* * * * *